United States Patent [19]

Bolt

[11] Patent Number: 4,944,314

[45] Date of Patent: Jul. 31, 1990

[54] CIGARETTE ENDS TESTING

[75] Inventor: Reginald C. Bolt, Saunderton, England

[73] Assignee: Molins PLC, Milton Keynes, England

[21] Appl. No.: 79,525

[22] Filed: Jul. 30, 1987

[30] Foreign Application Priority Data

Jul. 30, 1986 [GB] United Kingdom ..... 8618639

[51] Int. Cl.[5] ..... A24C 5/32; A24C 5/34

[52] U.S. Cl. ..... 131/280; 131/908; 250/223 R; 209/536; 209/546; 356/445

[58] Field of Search ..... 131/280, 904, 905, 907, 131/908, 906; 250/223 R; 356/445, 237; 209/536, 546

[56] References Cited

U.S. PATENT DOCUMENTS

| | | | |
|---|---|---|---|
| 3,334,240 | 8/1967 | Black | 131/907 |
| 3,557,375 | 1/1971 | Schmermund | 131/908 |
| 4,266,674 | 5/1981 | Bell et al. | 209/546 X |
| 4,269,201 | 5/1981 | Powell et al. | 131/280 |
| 4,377,743 | 3/1983 | Bolt et al. | 209/536 X |
| 4,484,591 | 11/1984 | Wahle et al. | 131/280 |
| 4,486,098 | 12/1984 | Buchegger et al. | 209/536 X |
| 4,616,139 | 10/1986 | Heitmann | 131/905 |
| 4,645,921 | 2/1987 | Heitmann et al. | 250/223 R |
| 4,678,901 | 7/1987 | Focke et al. | 131/905 |
| 4,712,914 | 12/1987 | Cross et al. | 356/121 |
| 4,805,641 | 2/1989 | Radzio et al. | 131/280 |

FOREIGN PATENT DOCUMENTS

| | | | |
|---|---|---|---|
| 3146506 | 6/1983 | Fed. Rep. of Germany | 131/908 |
| 3146507 | 6/1983 | Fed. Rep. of Germany | 131/908 |
| 3243204 | 5/1984 | Fed. Rep. of Germany | 131/280 |
| 2060348 | 5/1981 | United Kingdom | 131/908 |

*Primary Examiner*—V. Millin
*Assistant Examiner*—Joe H. Cheng
*Attorney, Agent, or Firm*—Antonelli, Terry, Stout & Kraus

[57] ABSTRACT

A cigarette ends tester includes a conveyor for conveying cigarettes sideways past a source of light arranged to direct light substantially axially into the ends of successive cigarettes in such a way that the paper wrapper around the end of each cigarette is illuminated if there is insufficient tobacco in the end, and a detecting device for monitoring the consequent external illumination of the end of the cigarette. The test signal for each cigarette is evaluated against a reference signal derived from satisfactory cigarettes tested previously during a predetermined time interval, thus compensating for variable factors affecting the test signal, such as ageing or dirt on the light emitting or detecting devices.

7 Claims, 3 Drawing Sheets

INNER DETECTOR CIRCUIT
(OUTER CIRCUIT IDENTICAL)
REFERENCE CAPACITOR
COMMON TO BOTH DETECTORS
DETECTORS 16
50K
A1
B1
10K
A2
C1
B2
10K
470K
22
10µF
+15V.
+1V.
+10V.
-5V.
6K8
A3
C2
10K
L1
H1 FOR FAULT
D LATCH
DAC 0800
8-BIT D-A
LSB
MSB
24
6K8
6K8
I REF
HEX SWITCH
26
SENSITIVITY
4538
10µS MONO
23
220Ω
100µF 16V.
OUTER SOURCE
INNER SOURCE
12
1A
TR
3R3
3K3
C4V7
100µS MONO
20
STROBE
1mS WIDTH
15mS PERIOD

CIGARETTE ENDS TESTING

This invention is concerned with a device for testing the ends of cigarettes to detect cigarette ends which are inadequately filled with tobacco. Such cigarettes may be rejected automatically. An earlier proposal using a source of light and a light detector is described in our British patent specification No. 1335662.

According to the present invention, a device for testing the ends of cigarettes comprises means for conveying cigarettes sideways past a source of light arranged to direct light substantially axially into the ends of successive cigarettes in such a way that the paper wrapper around the end of each cigarette is illuminated if there is insufficient tobacco in the end, and means for monitoring the consequent external illumination of the end of the cigarette.

The source of light is preferably mounted in a member which is contacted by each cigarette to prevent direct transmission of light (i.e. between the member and the cigarette) towards the light detector. The source of light may be unfocussed so as to emit a wide-angle diverging beam capable of illuminating the entire wrapper around an inadequately filled cigarette end.

Preferably there are a number of detectors focussed onto circumferentially spaced areas of the wrapper. For example, there may be two pairs of detectors between which the cigarettes are arranged to pass during testing.

The test signal for each cigarette is preferably evaluated against a reference signal derived from satisfactory cigarettes tested previously during a predetermined time interval.

An example of a testing device according to this invention is illustrated digrammatically in the accompanying drawings. In these drawings.

Figure 1:
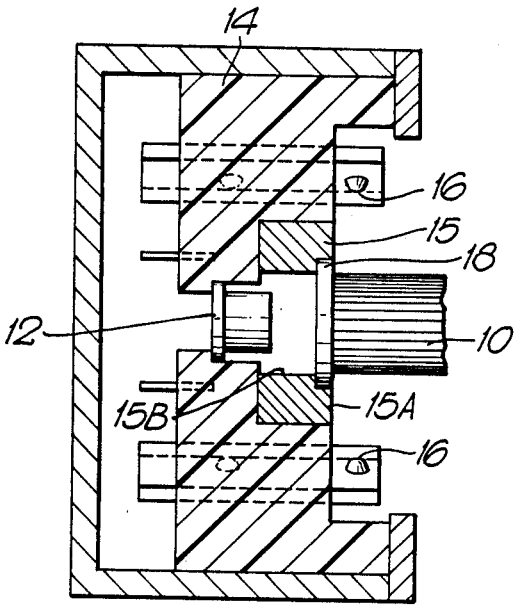
FIG. 1 is a section in a plane normal to the direction of movement of the cigarette at the test station.
Figure 2:
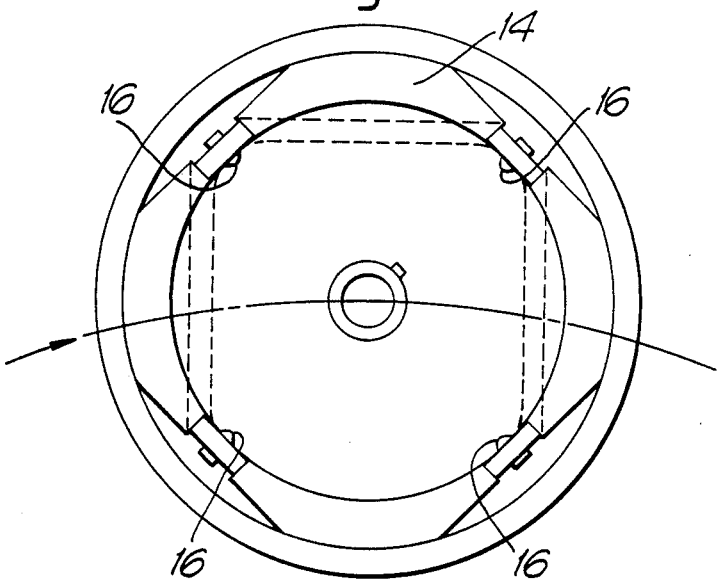
FIG. 2 is an end view of the device without the cigarette.

FIG. 1 shows one cigarette 10 at a testing station in which it is axially aligned with a light-emitting diode 12 mounted in a member 14 so as to be recessed from the surface of the member 14 adjacent to the end of the cigarette. As seen in FIGS. 1 and 2, an annular insert 15 in the member 14 serves as a shield preventing or minimizing the direct transmission of light from the source 12 to a number of light detectors in the form of photo-transistors 16 arranged to detect light emanating from the wrapper in the region of the cigarette end.

Light from the source 12 enters the cigarette via a thin transparent window 18 which seals the aperture containing the source 12 and forms a smooth continuation of the surface 15A of the member 15 adjacent to the cigarette end and having a light transmitting bore 15B of diameter equal to that of the cigarette (or slightly less). In practice, each cigarette end is intended to contact the member 15 immediately before and after testing, and to contact the window 18 during testing.

The source 12 emits a beam diverging by about 80 degrees so as to illuminate the cigarette wrapper to an extent dependent upon the amount of tobacco in the cigarette end. Each of the photo-transistors 16 is able to detect illumination of the wrapper to an angle of approximately 34 degrees with a reduction of sensitivity at the extremities of not more than 50%. Accordingly, as also apparent from FIG. 2, the four detectors 16 cover substantially the entire circumference of the cigarette.

By way of example, the source 12 may be a G.E. F5E1 device capable of being pulsed at 1 amp for 100 microseconds. The detectors 16 are Optron OP603 or OP643 phototransistors.

Figure 3:
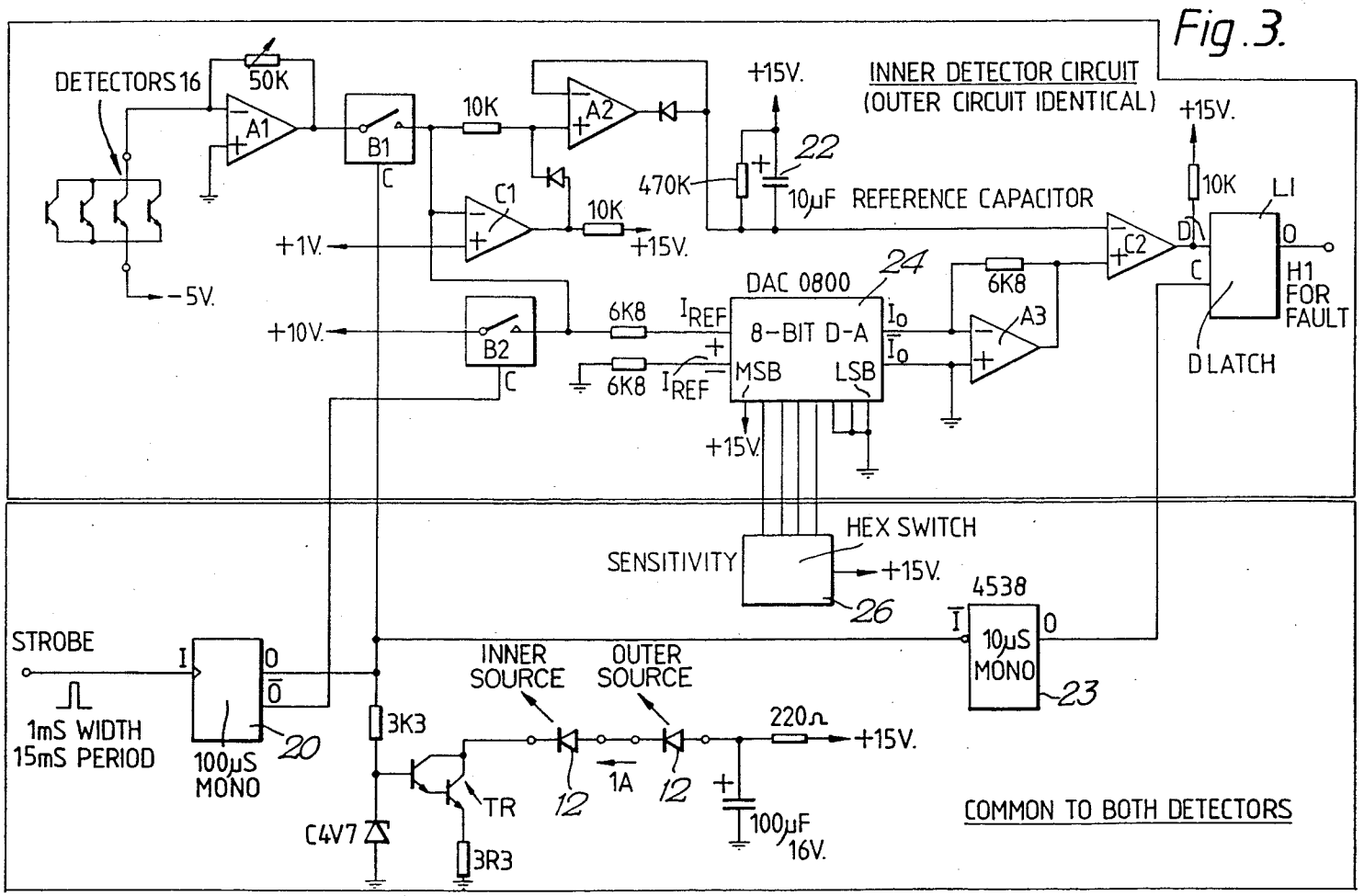
FIG. 3 shows a simplified control circuit used in the testing of cigarettes.

FIG. 3 shows two sources 12 for testing the ends of two rows of cigarettes simultaneously. The remainder of FIG. 3 shows the circuit for one test arrangement and is duplicated if two rows are to be tested.

Figure 4:
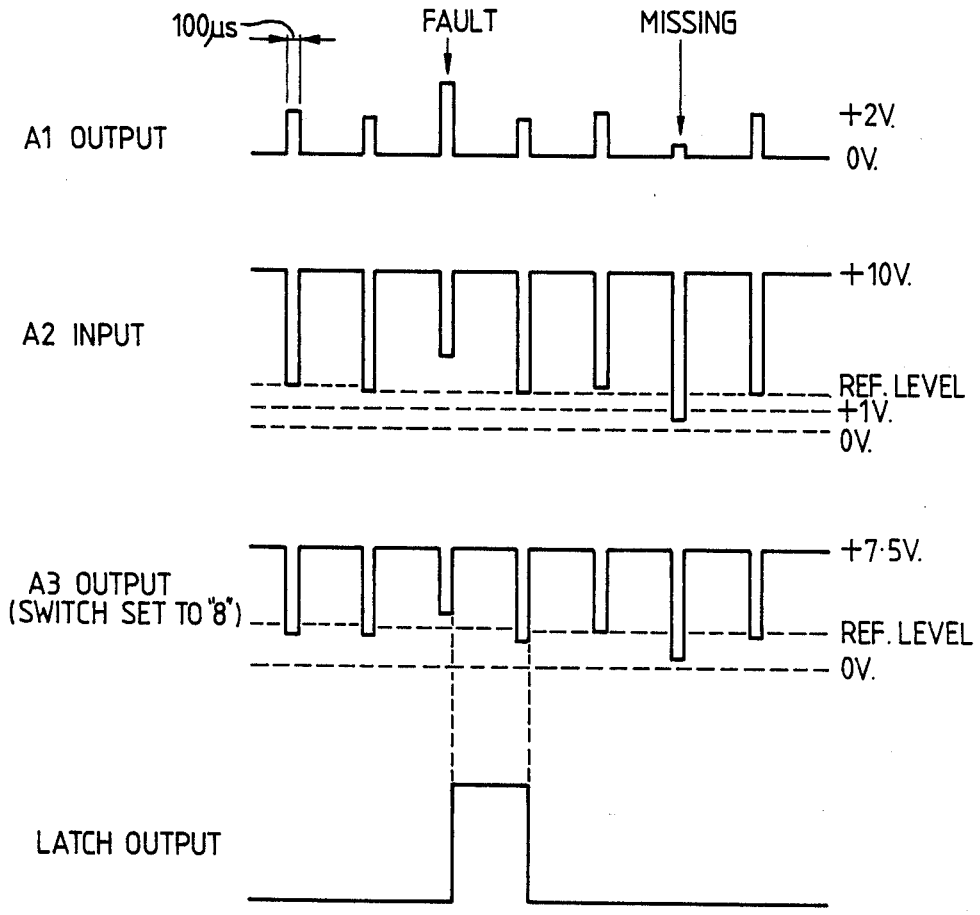
FIG. 4 shows signal wave forms achieved during testing.

Each test occurs during a period of 100 microseconds timed by a strobe pulse which is transmitted via a monostable device 20 to a transistor pair TR to strobe the two light sources 12. As a result of two solid-state switches B1 and B2, which are controlled by the monostable device 20, the combined signal received from the four detectors via amplifier A1 is applied to amplifier A2 and effectively inverted (see the A2 input wave form in FIG. 4), to produce a negative-going signal and the amplitude of each pulse at the output of amplifier A2 is averaged by a capacitor 22 to establish a reference level. The capacitor 22 with a 10 second time constant stores a potential corresponding to this reference level. A digital attenuator 24 controlled by a hexadecimal switch 26 reduces, by a set proportion, the signal level of the pulses received from each individual cigarette, and the result is fed via amplifier A3 to a comparator C2 in which each signal is compared with the reference potential provided by capacitor 22. A signal from any given cigarette which exceeds the reference potential by a set amount (e.g. 1.33 times) will result in a fault signal being emitted by the comparator C2 and stored in a latch L1 under control of a monostable circuit 23. A faulty cigarette may be automatically rejected by any well known ejector means in response to the fault signal.

The arrangement enables cigarette ends to be tested reliably without undue sensitivity to temperature, ambient light, or ageing or misalignment of the light emitting and detecting devices.

It should be noted that missing cigarettes are detected and that signals from them are not transmitted to the reference capacitor. For this purpose amplifier C1, on receiving a signal of less than 1 V, causes the A2 output to go positive so as not to change the reference capacitor voltage.

I claim:

1. A device for testing the ends of cigarettes, comprising:

means for conveying cigarettes sideways through a test station past a source of light arranged to direct light across the entire cross section and into the ends of successive cigarettes using a wide-angle diverging beam capable of illuminating the entire wrapper around an inadequately filled cigarette end in such a way that the paper wrapper around the end of each cigarette is illuminated if there is insufficient tobacco in the end, wherein the light from said wide angle diverging beam is directed in an unimpeded manner into the end of the cigarette; means for monitoring external illumination at the end of the cigarette, including at least one light detector positioned to detect light passing through the wrapper at the end of a cigarette at said test station; and means responsive to an output signal from said monitoring means for generating a fault signal upon detection of a cigarette having insufficient tobacco in the end.

2. A device according to claim 1 in which the source of light is mounted in a member which is arranged to be contacted by an end of each cigarette to prevent direct transmission of light towards the light detector.

3. A device according to claim 2 in which the said member has a light-transmitting bore having a diameter substantially equal to that of the cigarettes and having a window member for closing the end of the light-transmitting bore adjacent to the end of the cigarette.

4. A device according to claim 1 including a number of light detectors focussed onto respective circumferentially spaced areas of the wrapper of the cigarette at the test station.

5. A device for testing the ends of cigarettes, comprising a source of light arranged to direct a wide-angle diverging beam of light across the entire cross section and into the ends of successive cigarettes being conveyed sideways through a test station so that the paper wrapper around the end of each cigarette is illuminated to the extent that insufficient tobacco is provided in the end thereof, wherein the light from said wide angle diverging beam is directed in an unimpeded manner into the end of the cigarette; means for detecting external illuminating passing through the wrapper at the end of each cigarette so as to produce a series of test pulses each having an amplitude indicative of the level of illumination detected for a respective cigarette; and control means for evaluating the test pulse from each cigarette against a reference signal derived from the test pulses of satisfactory cigarettes tested previously during a predetermined time interval, including means connected to receive said test pulses from said detecting means for producing a reference potential representing an average of a plurality of test pulses, comparator means connected to receive said reference potential and said test pulses for comparing the individual test pulses to said reference potential and for generating a fault signal when a test pulse exceeds said reference potential, and controllable means connected between said detecting means and said comparator means for adjusting the level of said test pulses by a selected proportion and for applying said adjusted test pulses to said comparator means for comparison with said reference potential.

6. A device according to claim 5, wherein said controllable means comprises a digital attenuator.

7. A device according to claim 5, wherein said reference potential producing means includes means for inhibiting the averaging of test pulses which have a level indicative of the absence of a cigarette at the test station.

* * * * *